United States Patent [19]

Yoshida et al.

[11] 4,047,977

[45] Sept. 13, 1977

[54] METHOD OF CONTINUOUS GALVANIZING STEEL STRIP ON PARTIAL OR ONE SIDE

[75] Inventors: Katsuyoshi Yoshida; Yukio Kitajima, both of Tokai, Japan

[73] Assignee: Nippon Steel Corporation, Japan

[21] Appl. No.: 627,472

[22] Filed: Oct. 30, 1975

Related U.S. Application Data

[63] Continuation-in-part of Ser. No. 356,171, May 1, 1973, abandoned.

[30] Foreign Application Priority Data

May 4, 1972 Japan ..... 47-44418

[51] Int. Cl.[2] ..... C23C 1/02

[52] U.S. Cl. ..... 148/6.2; 427/300; 427/321; 427/329; 427/282; 427/287; 134/38

[58] Field of Search ..... 427/328, 329, 330, 321, 427/300, 226, 95, 282–287; 148/6.2; 134/38

[56] References Cited

U.S. PATENT DOCUMENTS

| | | | |
|---|---|---|---|
| 2,498,485 | 2/1950 | Clawson | 427/300 X |
| 2,743,192 | 4/1956 | White | 427/379 |
| 2,894,850 | 7/1959 | Greene et al. | 427/321 X |
| 3,055,776 | 9/1962 | Stevenson et al. | 427/95 |
| 3,177,085 | 4/1965 | Adams | 427/300 |
| 3,758,388 | 1/1973 | Shotten | 156/2 X |

*Primary Examiner*—Ralph S. Kendall
*Attorney, Agent, or Firm*—Wenderoth, Lind & Ponack

[57] ABSTRACT

A method of continuous galvanizing a steel strip partially or one side, which comprises applying silicone resin to a part or on one side of the steel strip which is to be left non-plated in a subsequent continuous molten zinc coating, baking the silicon resin coated steel strip at a temperature ranging from 300 to 800° C in an oxidizing atmosphere, and subjecting the steel strip to heat treatment in a reducing atmosphere and introducing the heat treated steel strip to a zinc coating bath.

9 Claims, 3 Drawing Figures

METHOD OF CONTINUOUS GALVANIZING STEEL STRIP ON PARTIAL OR ONE SIDE

Figure 1:
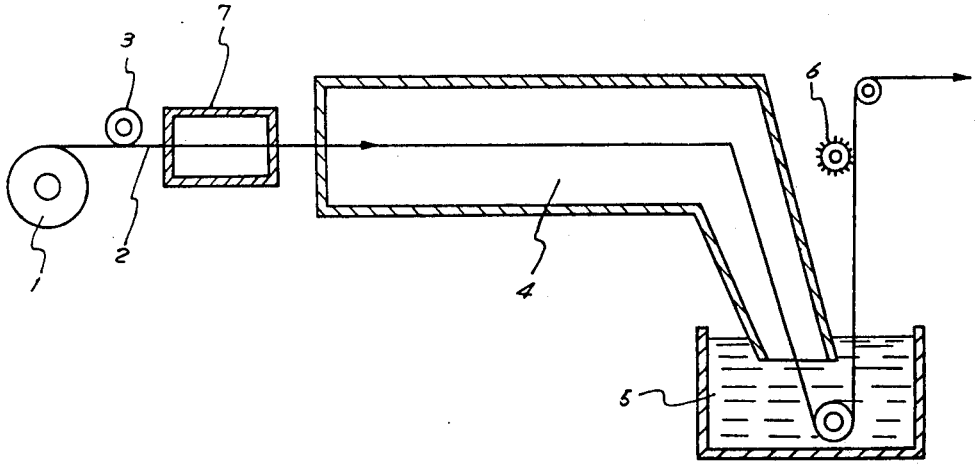

This application is a continuation-in-part of our copending application Ser. No. 356,171 filed May 1, 1973, now abandoned.

The present invention relates to a method of continuous galvanizing steel strip on partial or one side.

In recent years, in automobile and electric industries, for example, demands have been increasingly made for partially or one side coated steel sheets galvanizing partial or one side as a steel material having good corrosion resistance on one side and good weldability and paintability on the other side.

To meet these demands, it has been in practice to produce such partially or one-side galvanized steel sheets by electroplating. However, the thickness of coating normally obtained by electroplating is small, and therefore it is necessary to increase the coating amount with sacrifice of productivity in order to obtain satisfactory corrosion resistance. On the other hand, a thick coating can be obtained by a hot dipping method, and for production of partially or one side galvanized steel sheets, it has been proposed to apply a phosphoric acid treatment partially or to one side of the sheet and then galvanize the sheet as disclosed in Japanese patent publication Sho No. 42-24966, or it has been proposed to apply water glass partially or on one side of the sheet so as to prevent the coating deposition as disclosed in Japanese patent publication Sho No. 39-7112, and other various methods have been proposed. These prior arts, however, are applicable and effective only for a galvanizing method where no pretreatment by heating is applied just before the hot dipping, such as in Cook-Norteman method, and these prior arts can not be applied to a galvanizing apparatus such as the Sendzimir type or a no-oxidizing furnace type in which the heat treatment is done in the production line to obtain required surface and material properties, because the treating agents such as phosphate and water glass are denatured and decomposed and peeled off during the heating for removing the steel surface contamination and during the heating above recrystallization temperature for annealing the steel strip, which heatings are normally done in such a plating process, and thus it is impossible to prevent galvanizing.

One of the objects of the present invention is to provide a method for partially or one side coating effectively and advantageously even in a galvanizing line having a heat treatment furnace, such as the Sendzimir type coating line and the no-oxidizing furnace type coating line.

One of the feature of the present invention is that silicone resin is applied partially or on one side of a steel strip and thus silicone resin applied steel strip is baked at a temperature ranging from 300 to 800° C in an oxidizing atmosphere, then subjected to a heat treatment in a reducing atmosphere and is introduced to a galvanizing bath.

Another feature of the present invention is that one or more of metallic oxides, metallic hydroxides, metallic nitrides, metallic carbides, metallic carbonates, metallic phosphates, metallic silicates, etc. is added to the silicone resin.

As for the silicon resins used in the present invention, polysilalkylene polymers having the formula:

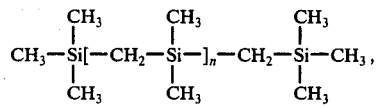

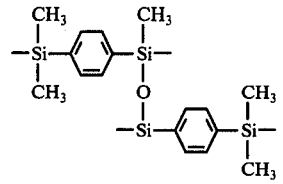

normal chained or ringed polysiloxene polymers such as

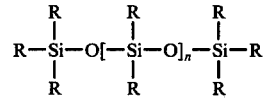

or $[(R)_2SiO]_n$ or further, condensation polymers of organo silanol such as HO — $[SiR_2O]_n$ — H (in which R is methyl, ethyl, butyl, phenyl or benzyl radical, etc.) are particularly useful.

The above silicone polymers may be used in single or in combination.

However, for obtained completely partial or one side galvanized steel sheet, it is desired to improve heat resistance of the resin coating. For this purpose, metallic oxides such as $SiO_2$, $Al_2O_3$, MgO, $TiO_2$, metallic nitrides such as $SiN_4$, carbides, phosphates and silicates such as WC, $CaCO_3$, $NaCO_3$, $Ca_3(PO_4)_2$, $AlPO_4$, $CaSiO_3$ can be added to the silicone resin in single or in combination.

The amount of these additives to be added to the silicone resin is less than 50% by weight, and more than about 50% it is difficult to coat the resin uniformly and the coating peels off often during the galvanizing.

As for the method for coating the above silicone resins on the steel strip, a spray coating, a roll coating and a squeeze coating, for example, may be applied to apply a uniform coating on the surface to be treated.

And the silicone resin is dissolved in an organic solvent such as carbon tetrachloride, benzene, toluene, and xylene so as to adjust the viscosity of the resin to meet the coating conditions.

As for the silicone resin used in the present invention, KF 96, KM 722, KS 66, KE 45 RTV, KR 255 (all are trademarks) produced by Shinetsu Chemical Industries Co., Ltd. of Japan and SH 200 (trademark) produced by Toray Silicone Co., Ltd. may be used.

The silicone resin is applied to the steel strip surface in advance of a pretreatment equipment, and then the resin coated steel strip is baked at a temperature ranging from 300° to 800° C in an oxidizing atmosphere, then subjected to a heat treatment in a reducing atmosphere and introduced in the hot dipping bath to be applied with the zinc coating on the non-resin-coated surface. In some cases, a very small amount of metal coating attaches infragments on the resin coated steel strip surface. Therefore, it is desirable to apply brushing to the resin coated surface of the steel strip coming out from the hot dipping bath to remove the coated metal as well as to remove the silicone resin coating.

As described hereinbefore, the feature of the present invention lies in that the silicone resin coated steel strip is baked at a temperature ranging from 300° to 800° C in an oxidizing atmosphere, and then subjected to a heat treatment in a reducing atmosphere. This is the indispensable feature of the present invention as is understood from the following example in which di-methylpolysiloxane is used.

The di-methylpolysiloxane is thermally decomposed in a reducing atmosphere ($H_2$ : 5%, balance: $N_2$) as below:

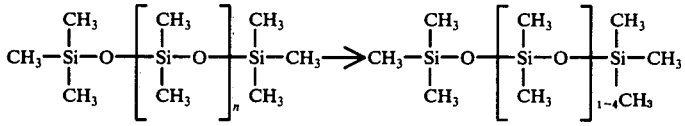

and vapourizes as low-molecular siloxane, which fills the furnace inside, and adheres not only on the silicone resin coated side but also on the other side to be plated. In this way, the side to be plated will show locally bad plating adhesion and in the worst case will not be plated at all, while the side to be left non-plated will be locally plated due to the loss of the silicone resin coating by its vapourization. In some cases, this non-plating or bad plating adhesion problem will exist even after completion of the one-side plating until the low-molecular silicone resin remaining in the furnace is replaced by the atmosphere gas.

Whereas, when the heating is done under the presence of oxygen, the dimethylpolysiloxane takes the following reaction:

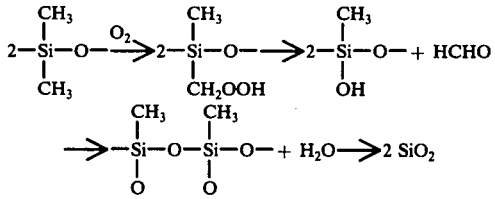

Figure 2:
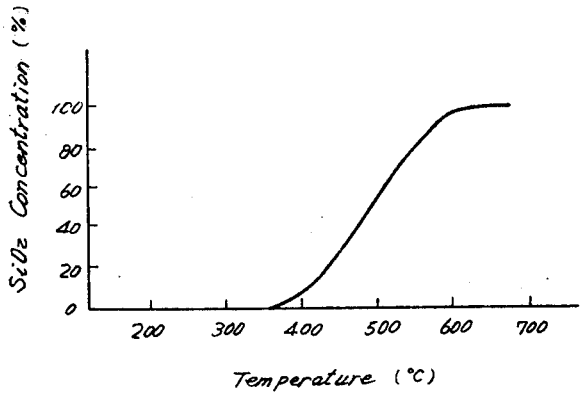
Figure 3:
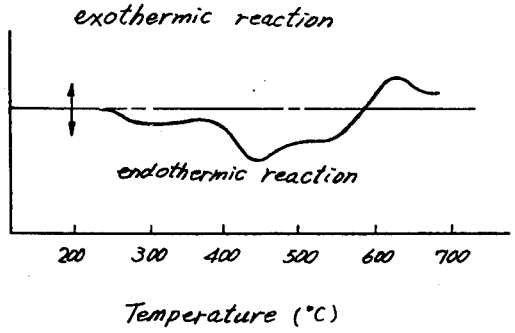

The results of measurements of the above reaction are shown in FIG. 2 and FIG. 3. As shown, in an oxidizing atmosphere (oxygen not lower than 1.0%) the dimethylpolysiloxane begins to decompose near 300° C, completes endothermic reaction near 600° C and finally decomposes into $SiO_2$. This reaction causes a weight decrease of about 1.9% theoretically, but about 90% or more weight decrease is measured by a thermobalance due to increasing tendency of vapourization through decomposition into a low-molecular substance.

When the baking of the silicone resin in the oxidizing atmosphere is not enough, the formation of $SiO_2$ film through the resin decomposition on the steel strip surface is not satisfactory and a large amount of residual non-decomposed silicone resin is brought into the reducing furnace so that thermal decomposition is caused in the reducing atmosphere and the low-molecular siloxane resin is formed as mentioned before and this low-molecular siloxane brings forth undesirable phenomena such as local plating on the side to be left non-plated, local non-plating on the side to be plated, and existance of bad plating adhesion until after the one-side plating.

When the baking of the silicone resin in an oxidizing atmosphere is done excessively, most of the coated resin vapourizes so that the steel strip is not fully coated by the residual $SiO_2$ film alone, and thus the steel strip is activated in the reducing furnace so that contact between the steel strip and the molten zinc is caused in the molten zinc bath and thus the zinc plating takes place on the resin coated side. Further, the steel strip surface is oxidized beyond the capacity of the reducing furnace so that the bluing phenomenon takes place.

In order to obtain good one-side zinc plating, it is important that in the reducing furnace the $SiO_2$ film covers the silicone resin coated side of the steel strip and protect the surface from activation while a small amount of the low-molecular silicone resin covers the steel strip surface so as to avoid the non-plating on the other side, and that in the molten zinc bath the strong $SiO_2$ film prevents the contact between the molten zinc and the steel strip. For this purpose, it is necessary that the baking temperature for the silicone resin under the presence of oxygen is not lower than 300° C but not higher than 800° C.

The thermal decomposition of the silicone resin completes near 600° C, but in a commercial production line as the heating rate is higher, the resin decomposition delay so that the decomposition reaction sometimes continues up to 800° C.

For actual practice, an optimum baking temperature should be determined within the range from 300° C to 800° C taking into consideration operational conditions such as the line speed, the condition of the reducing furnace, the presence of an oxidizing heating furnace or a non-oxidizing heating furnace prior to the reducing furnace and the like.

Then the steel strip is introduced to the reducing furnace where the steel strip surface to be plated is reduced and activated and is introduced to the plating bath.

The above heating within the range from 300° to 800° C is done for 2 to 30 seconds, more desirably for 4 to 20 seconds. The heating for 2 seconds or shorter, the reaction of dimethylsiloxane does not fully progress and in the subsequent treatments in the reducing furnace etc. non-decomposed dimethylsiloxane is thermally decomposed into a low-molecular substance and vapourizes in the furnace.

Thus, many non-plated portions appear on the zinc-plated side, and zinc adheres on the side to be left non-plated. Even when the heating time exceeds about 30 seconds the result will be same as obtained by the heating for about 20 seconds in case of a heating temperature up to about 400° C, and no economical advantage is obtained by a longer heating time.

When the heating is done at a temperature within a range from 500° to 800° C for 30 seconds or longer, the film composed mainly of $SiO_2$ formed during the heating is embrittled by the heat and becomes less effective to prevent the contact between the steel strip and the molten zinc in the bath.

As for the removal of the remaining (metal resin) coating, acid pickling such as by HCl or $H_2SO_4$, or etching by a chromate treating liquid which is applied as an aftertreatment is effective for the removal.

As for the above mentioned chromate treating liquid, a chemical conversion treatment liquid commonly used for preventing white rust of zinc coated steel plates, namely a chromate treatment liquid is useful, and typical examples includes;

a. $CrO_3$ — fluorine compound: Example: $CrO_3$ 15 g/l; $Na_2SiF_6$ 2g/l b. $CrO_3$ — inorganic acid: Example: $CrO_3$ 10g/l; $H_2SO_4$ 2ml/l c. $CrO_3$ — inorganic acid - fluorine compound: Example: $CrO_3$ 15g/l; NaF 1g/l: $H_3PO_4$ 5ml/l.

Further, the steel strip may be pre-coated with the silicone resin and coiled in a separate line and then the steel strip is uncoiled while galvanized in the hot dipping line.

The amount of the resin coating to be applied on the metal surface is 0.5–50 g/m² as the silicone resin content for effectively prevention of metal coating.

In this way, partial or one side galvanizing can be attained advantageously even in a continuous galvanizing line equipped with an oxidizing furnace and a subsequent reducing furnace as a pretreatment equipment.

As for the above mentioned continuous galvanizing line, a conventional apparatus, such as of Armco-sendzimer type, Selas direct-fired heating type, United States Steel type, may be used. The steel strip which has been applied with silicone resin coating partially or on one side of the strip in the heat treating furnace of the continuous galvanizing line is heated to a temperature between 300° and 950° C for about 20 seconds to 9 minutes, and then dipped in the molten zinc plating bath, so that the steel strip is plated with zinc partially or on one side only. For the heating, it is effective to heat the strip in an oxidizing atmosphere at a temperature 300°–800° C. Thus, the silicone resin coating on the steel strip is oxidized in the heat treating furnace to form a thin $SiO_2$ film on the surface of the strip so that when the steel strip is dipped in the molten zinc plating bath, the bath is protected from contamination.

Further, since the silicone resin coating can be easily removed after the galvanizing, the primary object of the present invention to assure weldability can be attained with any sacrifice.

Also, the productivity of the ordinary coating can be maintained.

Next, one example of the apparatus for practising the present invention will be described referring to the attached drawing.

In FIG. 1, the steel strip 2 is uncoiled from the steel strip coil 1, one side of the steel strip 2 is applied with the silicone resin by means of the coating roll 3 (a spray may be used also), then the resin coated steel strip 2 is baked at a temperature ranging from 300° to 800° C in the oxidizing furnace 7, then annealed in the reducing pretreatment equipment 4 and introduced into the hot dipping bath 5 where it is coated with zinc on the other side, the amount of the zinc coating is controlled, and finally the silicone resin coating is removed from the strip furnace by means of the brushing roll 6 and the strip is coiled.

The present invention will be more clearly understood from the following examples.

Examples of the present invention will be set forth under. These examples were conducted using the above illustrated production apparatus.

(A)

| Examples | Amount of Silicone Resin Coating | Annealing Conditions | Temp. of Hot Dipping Bath | Amount of Coated Metal | Speed of Strip Pass |
|---|---|---|---|---|---|
| 1 | 6 g/m² (KM 722) | 740° C | 450° C | 183 g/m² | 50 m/min. |
| 2 | 32 (KF 96) | " | " | " | " |
| 3 | 47 (KE 45 RTV) | " | " | " | " |
| 4 | 17 (KR 255) | " | " | " | " |
| 5 | 0.7 (SH 200) | " | " | " | " |

| Examples | Material to be hot dipped | Silicone Resin | Additives to Silicone Resin | (%) | Amount of Resin Coating (g/m²) | Coating Position | Metal Coating | Bath Temp. (° C) | Dip Time (sec.) |
|---|---|---|---|---|---|---|---|---|---|
| 6 | Steel strip | KR255 | $Ca(OH)_2$ | 20 | 8.0 | one side wholly | Zn | 470 | 30 |
| 7 | Steel strip | KR255 | $Cr(OH)_2$ | 10 | 5.0 | one side wholly | Zn | 470 | 20 |
| 8 | Steel strip | SH 200 | $SiO_2$ | 30 | 1.2 | one side wholly | Zn | 470 | 40 |
| 9 | Steel strip | SH 200 | $SiN_4$ | 2 | 1.0 | one side wholly | Zn | 470 | 50 |
| 10 | Steel strip | SH 200 | TiC | 25 | 27 | one side wholly | Al | 700 | 40 |

| Example | Oxidating heating conditions | | | | Reducing atmosphere treating conditions | | | Results | |
|---|---|---|---|---|---|---|---|---|---|
| | Burner heating | Temp. 300° C (strip, temp.) | Heating time | Atmosphere | Max.Temp. | Time sec. | Zinc bath | Side to be non-plated | Side to be plated |
| 11 | in air | | 20 sec. | $H_2$: 75% $N_2$: Bal. | 720° C (strip, temp.) | 160 | 460 | completely | Very small non- |

-continued

| Example | Oxidating heating conditions | | | Reducing atmosphere treating conditions | | | | Results | |
|---|---|---|---|---|---|---|---|---|---|
| | | | | | | | | non-plated | plated spots (no practical problem) |
| 12 | " | 400 | 10 | " | " | 80 | " | " | Completely satisfactory |
| 13 | " | 500 | 8 | " | " | 64 | " | " | " |
| 14 | " | 700 | 6 | " | " | " | " | " | " |
| 15 | " | 800 | 6 | " | " | " | " | " | same as Example I |
| Comparative | " | 250 | 20 | " | " | 160 | " | plated discontinuously | Many button-like non-plated portion |

What is claimed is:

1. A method of continuous galvanizing a steel strip partially or one side, which comprises applying a silicone resin selected from the group consisting of polysilalkylenes and polysiloxanes to a part or on one side of the steel strip which is to be left non-plated in a subsequent continuous molten zinc coating, baking the silicone resin coated steel strip at a temperature ranging from 300° to 800° C for 2 to 30 seconds in an oxidizing atmosphere to deposit a masking film, and subjecting the steel strip to heat treatment in a reducing atmosphere and introducing the heat treated steel strip to a zinc coating bath.

2. A method according to claim 1, in which the silicone resin is coated in an amount of 0.5–50 g/m$^2$ as the resin content.

3. A method according to claim 1, in which one or more members selected from the group consisting of metallic oxides, metallic hydroxides, metallic nitrides, metallic carbides, metallic carbonates, metallic phosphates and metallic silicates is added to the silicone resin.

4. A method according to claim 3, in which the amount of the additive to the silicone resin is less than 50% by weight.

5. A method according to claim 1, in which the residual resin coating, after plating, is removed by acid pickling in an HCl solution.

6. A method according to claim 1, in which the residual resin coating, after plating, is removed by etching with chromate treating liquid effective to prevent white rust on zinc coated steel plates.

7. A method according to claim 1, in which the residual resin coating, after plating, is removed by brushing.

8. A method according to claim 1, in which the residual resin coating, after plating, is removed by acid pickling in an $H_2SO_4$ solution.

9. A method according to claim 1 wherein the baking temperature is between 400° and 800° C.

* * * * *